US007759299B2

(12) United States Patent
Smith et al.

(10) Patent No.: US 7,759,299 B2
(45) Date of Patent: Jul. 20, 2010

(54) WAREWASHING COMPOSITION FOR USE IN AUTOMATIC DISHWASHING MACHINES

(75) Inventors: Kim R. Smith, Woodbury, MN (US); Michael J. Bartelme, Eden Prairie, MN (US); Keith E. Olson, Apple Valley, MN (US)

(73) Assignee: Ecolab Inc., St. Paul, MN (US)

( * ) Notice: Subject to any disclaimer, the term of this patent is extended or adjusted under 35 U.S.C. 154(b) by 349 days.

(21) Appl. No.: 11/491,784

(22) Filed: Jul. 24, 2006

(65) Prior Publication Data

US 2008/0020960 A1 Jan. 24, 2008

(51) Int. Cl.
*C11D 7/10* (2006.01)

(52) U.S. Cl. ..... 510/224; 510/220; 510/225; 510/227; 510/233; 510/445; 510/446; 510/485; 510/508; 510/514

(58) Field of Classification Search ..... 510/220, 510/224, 225, 227, 233, 445, 446, 485, 508, 510/514
See application file for complete search history.

(56) References Cited

U.S. PATENT DOCUMENTS

| | | | | |
|---|---|---|---|---|
| 2,447,297 | A | | 8/1948 | Wegst et al. |
| 2,514,304 | A | | 7/1950 | Bacon et al. |
| 2,575,576 | A | | 11/1951 | Bacon et al. |
| 3,048,548 | A | | 8/1962 | Martin et al. |
| 3,128,250 | A | | 4/1964 | Lintner |
| 3,255,117 | A | | 6/1966 | Knapp et al. |
| 3,334,147 | A | | 8/1967 | Brunelle et al. |
| 3,350,318 | A | | 10/1967 | Green |
| 3,442,242 | A | | 5/1969 | Laskey et al. |
| 3,677,820 | A | | 7/1972 | Rutkowski |
| 3,701,736 | A | | 10/1972 | Austin et al. |
| 3,755,180 | A | | 8/1973 | Austin |
| 3,764,559 | A | | 10/1973 | Mizuno et al. |
| 3,966,627 | A | | 6/1976 | Gray |
| 4,102,799 | A | | 7/1978 | Finck |
| 4,390,441 | A | | 6/1983 | Beavan |
| 4,426,362 | A | | 1/1984 | Copeland et al. |
| 4,443,270 | A | | 4/1984 | Biard et al. |
| 4,501,681 | A | | 2/1985 | Groult et al. |
| 4,606,775 | A | | 8/1986 | Robinson et al. |
| 4,618,914 | A | | 10/1986 | Sato et al. |
| 4,687,121 | A | | 8/1987 | Copeland |
| 4,690,305 | A | | 9/1987 | Copeland |
| RE32,763 | E | | 10/1988 | Fernholtz et al. |
| RE32,818 | E | | 1/1989 | Fernholz et al. |
| 4,826,661 | A | | 5/1989 | Copeland et al. |
| 4,830,773 | A | | 5/1989 | Olson |
| 4,839,084 | A | * | 6/1989 | Ouhadi et al. ..... 510/338 |
| 4,908,148 | A | | 3/1990 | Caravajal et al. |
| 4,917,812 | A | | 4/1990 | Cilley |
| 4,933,101 | A | | 6/1990 | Cilley et al. |
| 4,954,280 | A | | 9/1990 | Elliott et al. |
| 5,152,910 | A | | 10/1992 | Savio et al. |
| 5,152,911 | A | | 10/1992 | Savio et al. |
| 5,169,552 | A | | 12/1992 | Wise |
| 5,229,027 | A | * | 7/1993 | Ahmed ..... 510/221 |
| 5,281,352 | A | | 1/1994 | Savio et al. |
| 5,292,446 | A | | 3/1994 | Painter et al. |
| 5,384,061 | A | | 1/1995 | Wise |
| 5,512,266 | A | | 4/1996 | Brown et al. |
| 5,624,892 | A | | 4/1997 | Angevaare et al. |
| 5,625,842 | A | | 4/1997 | Dalrymple |
| 5,698,506 | A | | 12/1997 | Angevaare et al. |
| 5,700,294 | A | | 12/1997 | Boittiaux et al. |
| 5,721,277 | A | | 2/1998 | Tang |
| 5,731,276 | A | * | 3/1998 | Argo et al. ..... 510/284 |
| 5,731,277 | A | | 3/1998 | Gary et al. |
| 6,037,319 | A | | 3/2000 | Dickler et al. |
| 6,150,324 | A | | 11/2000 | Lentsch et al. |
| 6,156,715 | A | | 12/2000 | Lentsch et al. |
| 6,164,296 | A | | 12/2000 | Lentsch et al. |
| 6,177,392 | B1 | | 1/2001 | Lentsch et al. |
| 6,228,825 | B1 | | 5/2001 | Gorlin et al. |
| 6,258,765 | B1 | | 7/2001 | Wei et al. |
| 6,303,553 | B1 | | 10/2001 | Gorlin |
| 6,369,021 | B1 | | 4/2002 | Man et al. |
| 6,410,495 | B1 | | 6/2002 | Lentsch et al. |
| 6,448,210 | B1 | | 9/2002 | Keyes et al. |
| 6,448,212 | B1 | | 9/2002 | Holderbaum et al. |

(Continued)

FOREIGN PATENT DOCUMENTS

DE 25 39 531 A1 3/1977

(Continued)

OTHER PUBLICATIONS

Altenschoepfer, T., "The Present Position of Investigations into the Behavior of Glass During Mechanical Washing," *The Effect of Detergents on Glassware . . . in Domestic Dishwashers, papers presented in symposium presided by W. W. Fletcher from the B.G.I.R.A—Sheffield held in the "Institut National du Verre" in Charleroi*, pp. 62-77 (Apr. 1971).

(Continued)

*Primary Examiner*—Charles I Boyer
(74) *Attorney, Agent, or Firm*—Andrew D. Sorensen; Laura C. DiLorenzo; Amy J. Hoffman

(57) ABSTRACT

A warewashing detergent composition is provided according to the invention. The warewashing detergent composition includes a cleaning agent, an alkaline source, and a corrosion inhibitor. The cleaning agent comprises a detersive amount of a surfactant. The alkaline source is provided in an amount effective to provide a use composition having a pH of at least about 8. The corrosion inhibitor includes a source of aluminum ion and at least one of a source of calcium ion or a source of magnesium ion. The amounts of calcium ion or magnesium ion can be selected depending upon the hardness of the water of dilution. Methods for using a warewashing detergent composition are provided.

11 Claims, No Drawings

| | | | | |
|---|---|---|---|---|
| 6,475,977 | B1 | 11/2002 | Pfeiffer et al. | |
| 6,605,578 | B1 | 8/2003 | Fleckenstein et al. | |
| 6,622,736 | B1 | 9/2003 | Hahn | |
| 6,632,785 | B2 | 10/2003 | Pfeiffer et al. | |
| 6,670,314 | B2 | 12/2003 | Smith et al. | |
| 6,727,215 | B2 | 4/2004 | Roberts et al. | |
| 7,101,833 | B2 | 9/2006 | Berger et al. | |
| 2003/0050205 | A1 | 3/2003 | Hahn | |
| 2003/0180466 | A1 | 9/2003 | Rohrbaugh et al. | |
| 2004/0077514 | A1 * | 4/2004 | Price et al. | 510/311 |
| 2004/0121926 | A1 * | 6/2004 | Waits et al. | 510/221 |
| 2004/0241820 | A1 * | 12/2004 | Outtrup et al. | 435/222 |
| 2005/0003979 | A1 | 1/2005 | Lentsch et al. | |
| 2005/0020464 | A1 * | 1/2005 | Smith et al. | 510/220 |
| 2005/0187127 | A1 * | 8/2005 | Somerville Roberts et al. | 510/336 |
| 2006/0030506 | A1 * | 2/2006 | Song et al. | 510/382 |
| 2006/0069001 | A1 * | 3/2006 | Song | 510/220 |
| 2006/0069005 | A1 * | 3/2006 | Song | 510/220 |
| 2006/0128586 | A1 * | 6/2006 | Lant et al. | 510/392 |
| 2008/0187958 | A1 * | 8/2008 | Nielsen et al. | 435/69.1 |

FOREIGN PATENT DOCUMENTS

| | | | |
|---|---|---|---|
| EP | 0 070 587 | A1 | 1/1983 |
| EP | 0 387 997 | B1 | 10/1995 |
| EP | 0 962 521 | B1 | 5/2004 |
| GB | 1442 885 | | 7/1976 |
| GB | 1 517 029 | | 7/1978 |
| GB | 2 364 324 | | 1/2002 |
| GB | 2 372 500 | A | 8/2002 |
| WO | WO 96/36687 | | 11/1996 |
| WO | WO00/39259 | | 7/2000 |
| WO | WO 00/56851 | | 9/2000 |
| WO | WO 02/068352 | A2 | 9/2002 |
| WO | WO 2004/061067 | A2 | 7/2004 |
| WO | WO 2004/061068 | A1 | 7/2004 |
| WO | WO 2004/061069 | A1 | 7/2004 |
| WO | WO 2004/061070 | A1 | 7/2004 |
| WO | WO 2005/005589 | A1 | 1/2005 |
| WO | WO 2005/033724 | A1 | 4/2005 |
| WO | WO2006/011934 | | 2/2006 |

OTHER PUBLICATIONS

Mayaux, P., "Mechanism of Glass Attack by Chemical Agents," *The Effect of Detergents on Glassware . . . in Domestic Dishwashers, papers presented in symposium presided by W.W. Fletcher from the B.G.I.R.A—Sheffield held in the "Institut National du Verre" in Charleroi*, pp. 1-8 (Apr. 1971).

"Chelating Agents," *Kirk-Othmer Encyclopedia of Chemical Technology—Castor Oil to Chlorosulfuric Acid*, Third Edition, vol. 5, pp. 339-367 (© 1979).

"Emulsions," *Kirk-Othmer Encyclopedia of Chemical Technology—Diuretics to Emulsions*, Third Edition, vol. 8, pp. 900-912 (© 1979).

Jourbert, D. et al., "Etching of Glassware in Mechanical Dishwashing," *Soap & Chemical Specialties*, pp. 5, 62, 64, and 67-68 (Mar. 1971).

"Table 4. Extraction Solvents and Reagents" and "Selected Sorbents," *Kirk-Othmer Encyclopedia of Chemical Technology*, Third Edition, vol. 23, pp. 319-320 (© 1979).

Mizuno, William G., "Dishwashing," *Surfactant Science Series, Detergency Theory and Test Methods*, Marcel Dekker Press, pp. 815-884 (© 1981).

* cited by examiner

WAREWASHING COMPOSITION FOR USE IN AUTOMATIC DISHWASHING MACHINES

FIELD OF THE INVENTION

The invention relates to warewashing compositions for use in automatic dishwashing machines and methods for using warewashing compositions in automatic dishwashing machines. The automatic dishwashing machines can be commercial or domestic dishwashing machines. The warewashing composition includes a corrosion inhibitor to reduce corrosion of glass. The corrosion inhibitor includes aluminum and at least one of calcium, magnesium, and zinc.

BACKGROUND OF THE INVENTION

Glassware that is repetitively washed in automatic dishwashing machines has a tendency to develop a surface cloudiness that is irreversible. The cloudiness often manifests itself as an iridescent film that displays rainbow hues in light reflected from the glass surface. The glass becomes progressively more opaque with repeated washings. This cloudiness is believed to be a type of etching or corrosion of the glass. This same type of corrosion can be seen on other articles including china, porcelain, and ceramics.

Corrosion of glass in automatic dishwashers is a well known phenomenon. A paper by D. Joubert and H. Van Daele entitled "Etching of Glassware in Mechanical Dishwashing" in Soap and Chemical Specialties, March, 1971, pp. 62, 64, and 67, discusses the influence of various detergent components, particularly those of an alkaline nature. This subject is also discussed in a paper entitled "The Present Position of Investigations into the Behavior of Glass During Mechanical Dishwashing" presented by Th. Altenschoepfer in April, 1971, at a symposium in Charleroi, Belgium, on "The Effect of Detergents on Glassware in Domestic Dishwashers." See, also, another paper delivered at the same symposium by P. Mayaux entitled "Mechanism of Glass Attack by Chemical Agents."

It is believed that the glassware corrosion problem relates to two separate phenomena; the first is corrosion or etching due to the leaching out of minerals from the glass composition itself together with hydrolysis of the silicate network, and the second is deposition and redeposition of silicate material onto the glass. Both phenomena can result in the cloudy appearance of glassware that has been washed repeatedly in automatic dishwashers. This cloudiness often manifests itself in the early stages as an iridescent film that becomes progressively more opaque with repeated washings.

Corrosion inhibitors have been added to automatic dishwashing compositions to reduce the etching or corrosion found on glass. For example, see U.S. Pat. No. 2,447,297 to Wegst et al.; U.S. Pat. No. 2,514,304 to Bacon et al.; U.S. Pat. No. 4,443,270 to Baird et al.; U.S. Pat. No. 4,933,101 to Cilley et al.; U.S. Pat. No. 4,908,148 to Caravajal et al.; U.S. Pat. No. 4,390,441 to Beavan. Zinc has been disclosed for use in preventing glass corrosion. For example, see U.S. Pat. No. 4,917,812 to Cilley; U.S. Pat. No. 3,677,820 to Rutkowski; U.S. Pat. No. 3,255,117 to Knapp; U.S. Pat. No. 3,350,318 to Green; U.S. Pat. No. 2,575,576 to Bacon et al.; U.S. Pat. No. 3,755,180 to Austin; and U.S. Pat. No. 3,966,627 to Gray. Automatic dishwashing detergent compositions incorporating aluminum salts have been disclosed for reducing glass corrosion. See International Publication No. WO 96/36687; U.S. Pat. No. 3,701,736 to Austin et al.; U.S. Pat. No. 5,624,892 to Angevaare et al.; and U.S. Pat. No. 5,624,892 to Angevaare et al.; and U.S. Pat. No. 5,598,506 to Angevaare et al.

Effort to control the corrosion of glass can be found in U.S. Pat. Application Publication No. US 2005-0003979 A1 that was filed with the U.S. Patent and Trademark Office on Jul. 2, 2003 and U.S. Patent Application Publication No. US 2005-0020464 A1 that was filed with the United States Patent and Trademark Office on Jun. 25, 2004.

SUMMARY OF THE INVENTION

Corrosion of glass can be characterized by the appearance of an iridescent film that displays rainbow hues of light reflected from the glass surface that progressively becomes more cloudy with additional washing. It is believed that one type of corrosion manifests itself as a film on the glass surface formed from precipitates, and another type of corrosion manifests itself as a result of etching the glass surface.

A warewashing detergent composition is provided according to the present invention. The warewashing detergent composition includes a cleaning agent, an alkaline source, and a corrosion inhibitor. The cleaning agent comprises a detersive amount of a surfactant. The alkaline source is provided in an amount effect to provide a use composition having a pH of at least about 8 when measured at a solids concentration of about 0.5 wt. %. The corrosion inhibitor can be provided in an amount sufficient for reducing corrosion of glass when the warewashing detergent composition is combined with water of dilution at a dilution ratio of dilution water to detergent composition of at least about 20:1. The corrosion inhibitor can comprise a source of aluminum ion, and at least one of a source of calcium ion or source of magnesium ion.

A corrosion inhibitor comprising a source of calcium ion can be favored when the water of dilution is characterized as soft water, and a corrosion inhibitor comprising a source of magnesium ion can be favored when the water of dilution can be characterized as hard water. Furthermore, the corrosion inhibitor can be selected containing both the source of calcium ion and the source of magnesium ion to provide corrosion inhibition properties in either soft water or hard water.

The corrosion inhibitor can additionally include a source of zinc ion. When the detergent composition contains a phosphorus containing builder, a source of zinc ion can be helpful for reducing corrosion. When the detergent composition contains a builder that can be characterized as a non-phosphorus containing builder, it may be desirable to provide the detergent composition without a source of zinc ion if the non-phosphorus containing builder is a type of builder that chelates with the source of zinc ion.

A method for using a warewashing detergent composition is provided according to the invention. The method includes steps of diluting the warewashing detergent composition with water of dilution at a ratio of water dilution to warewashing detergent composition of at least about 20:1, and washing glass with the use composition in an automatic dishwashing machine.

DETAILED DESCRIPTION OF THE INVENTION

The invention provides a warewashing composition for protecting articles such as glassware, ceramic, or porcelain from corrosion in an automatic dishwashing or warewashing machine during automatic dishwashing or warewashing. Glassware corrosion generally refers to corrosion that occurs on glassware, ceramic, or porcelain. Glassware corrosion can be detected as a cloudiness on the glass surface. Early stages of corrosion can be observed as an iridescent film that displays rainbow hues in light reflected from the glass surface. As the corrosion continues, the glassware progressively becomes more cloudy. Glass corrosion generally refers to a deterioration of the glass resulting from an etching of the glass due to the leaching out of minerals from the glass together with hydrolysis of the silicate network, a filming resulting from deposition and redeposition of silicate material onto the glass, or both.

The warewashing composition can be referred to as the warewashing detergent composition as the cleaning composition, or as the composition. The warewashing composition, can be available for cleaning in environments other than inside an automatic dishwashing or warewashing machine. For example, the composition can be used as a pot and pan cleaner for cleaning glass, dishes, etc. in a sink. It should be understood that the term "warewashing" refers to and is meant to include both warewashing and dishwashing. Furthermore, the warewashing composition can refer to the composition provided in the form of a concentrate or provided in the form of a use composition. In general, a concentrate is the composition that is intended to be diluted with water to provide the use composition that contacts the glass surface to provide the desired effect, such as, cleaning. Furthermore, the detergent composition can be used in environments including, for example, bottle washing and car washing. In general, the detergent composition can be used in any environment where it is desirable to reduce corrosion of glass, ceramic, or porcelain.

The warewashing composition includes an effective amount of a corrosion inhibitor to provide a use composition exhibiting resistance to glass corrosion. The phrase "effective amount" in reference to the corrosion inhibitor refers to an amount sufficent to provide a use composition exhibiting reduced glass corrosion compared with a composition that is identical except that it does not contain a sufficient amount of the corrosion inhibitor to reduce corrosion of glass after multiple washings The resistance to corrosion can be provided when the water of dilution is hard water or soft water, and can be provided in a warewashing composition that includes phosphorous or is free of phosphorous. In general, hard water is considered to be water having a total dissolved solids (TDS) content in excess of 200 ppm, and soft water is considered to be water having a total dissolved solids content of less than about 200 ppm. The dissolved solids refers to the presence of calcuim and magnesium. Hard water often includes a total dissolve solids content in excess of 400 ppm, and even in excess of 800 ppm. The hardness of the water can effect glass corrosion. In general, water having a higher total dissolved solids content has a tendency to corrode glass more quickly than water having a low level of total dissolved solids. The hardness of the water can be addressed in a number of ways. For example, the water can be softened. That is, the calcium and the magnesium present in the water can be replaced with sodium to soften the water. In addition, the warewashing composition can include builders or chelating agents at levels sufficient to handle the hardness. Water softeners, however, break down on occasion or run out of material that provides the softening effect. In addition, certain environments may provide water having a hardness that exceeds the builder or chelating capacity of the warewashing detergent composition. In such circumstances, there may be free calcium ion available that may contribute to glass corrosion. The warewashing composition can be provided with a corrosion inhibitor that resists glass corrosion even under these conditions.

There appears to a growing tendency for governmental agencies to restrict or eliminate the presence of phosphorous in warewashing compositions. Traditionally, warewashing compositions have included phosphates or phosphonates as builders or chelating agents. Because of the accumulative effect of phosphorous containing compounds in the environment, there is a tendency to ban phosphorous in warewashing compositions. When warewashing compositions are formulated that are free of phosphorous, other builders or chelating agents are typically used in place of phosphates or phosphonates. Non-phosphorous containing builders or chelating agents have a tendency to interact with components that may be present to protect glassware from corrosion. For example, the builder/chelating agent ethylenediaminetetraacetic acid (EDTA) has a tendency to chelate zinc. As a result, a warewashing composition containing zinc as a corrosion inhibitor may suffer a loss of zinc as a result of chelation ion with EDTA.

The warewashing composition that contacts the articles to be washed in an automatic dishwashing process can be referred to as the use composition. The use composition can be provided at a solids concentration that provides a desired level of detersive properties. The solids concentration refers to the concentration of the non-water components in the use composition. The warewashing composition prior to dilution to provide the use composition can be referred to as the warewashing composition concentrate or more simply as the concentrate. The concentrate can be provided in various forms including as a liquid or as a solid. Pastes and gels can be considered types of liquid. Powders, agglomerates, pellets, tablets, and blocks can be considered types of solid.

The warewashing composition can be used by diluting the concentrate with water at the situs or location of use to provide the use composition. In many cases when using the warewashing composition in an automatic dishwashing or warewashing machine, it is expected that that situs or location of use will be inside the automatic dishwashing or warewashing machine. When the warewashing composition is used in a residential or home-style dishwashing machine, the composition can be placed in the detergent compartment of the dishwashing machine. Often the detergent compartment is located in the door of the dishwashing machine. The warewashing composition can be provided in the form that allows for introduction of a single dose of the warewashing composition into the compartment. In general, a single dose refers to the amount of the warewashing composition that is desired for a single warewashing cycle. In many commercial dishwashing or warewashing machines, and even for certain residential or home-style dishwashing machines, it is expected that a large quantity of warewashing composition can be provided in a compartment that allows for the release of a single dose amount of the composition for each warewashing or dishwashing cycle. Such a compartment may be provided as part of the warewashing or dishwashing machine or it may be provided as a separate structure connected to the warewashing or dishwashing machine by a hose for delivery of the composition to the warewashing or dishwashing machine. For example, a block of the warewashing composition can be provided in a hopper, and water can be sprayed against the surface of the block to provide a liquid concentrate that can be introduced into the dishwashing machine. The hopper can be a part of the dishwashing machine or it can be provided separate from the dishwashing machine.

The water that is used to dilute the concentrate to form the use composition can be referred to as water of dilution, and can vary from one location to another. It is expected that water available at one location may have a relatively low level of total dissolved solids while water at another location may have a relatively high level of total dissolved solids. In general, hard water is considered to be water having a total dissolved solids content in excessive of 200 ppm. The warewashing detergent composition according to the invention can be provided so that corrosion inhibition properties are provided in the presence of water of dilution that is soft water or water of dilution that is hard water.

The detergent composition concentrate can be provided so that it is free of phosphorous. In general, the reference to a composition being free of phosphorous means that the composition contains no intentionally added phosphorous containing components. It should be understood that various components may include trace amounts of phosphorous. However, a composition that is free of phosphorous does not include phosphate or phosphonate builder or chelating components as an intentionally added component. When the composition is free of phosphorous, the composition can contain non-phosphorous containing builders or chelating agents.

The use composition can have a solids content that is sufficient to provide the desired level of cleaning while avoiding wasting the warewashing composition by using too much. In general, the use composition can have a solids content of at least about 0.05 wt. % to provide a desired level of cleaning. In addition, the use composition can have a solids content of less than about 1.0 wt. % to avoid using too much of the composition. In addition, the use composition can have a solids content of about 0.05 wt. % to about 0.75 wt. %.

The use composition can be prepared from the concentrate by diluting with water at a dilution ratio that provides convenient use of the concentrate and provides the formation of a use composition having desired detersive properties. The concentrate can be diluted at a ratio of water to concentrate of at least about 20:1, and can be at about 20:1 to about 2000:1, to provide a use composition having desired detersive properties.

The warewashing composition can be provided in the form of a solid. Exemplary solid dishwashing compositions are disclosed in U.S. Pat. No. 6,410,495 to Lentsch et al., U.S. Pat. No. 6,369,021 to Man et al., U.S. Pat. No. 6,258,765 to Wei et al, U.S. Pat. No. 6,177,392 to Lentsch et al., U.S. Pat. No. 6,164,296 to Lentsch et al., U.S. Pat. No. 6,156,715 to Lentsch et al., and U.S. Pat. No. 6,150,624 to Lentsch et al. The compositions of each of these patents are incorporated herein by reference. The compositions of each of these patents can be modified to provide a warewashing composition that includes an effective amount of a corrosion inhibitor to provide a desired reduction of etching and filming of glass.

Corrosion Inhibitor

The corrosion inhibitor can be included in the warewashing composition in an amount sufficient to provide a use composition that exhibits a rate of corrosion of glass that is less than the rate of corrosion of glass for an otherwise identical use composition except for the absence of the corrosion inhibitor. The corrosion inhibitor refers to the combination of a source of aluminum ion and at least one of a source of calcium ion, a source of magnesium ion, or a source of zinc ion. The source of aluminum ion, the source of calcium ion, the source of magnesium ion, and the source of zinc ion provide aluminum ion, calcium ion, magnesium ion, and zinc ion, respectively, when the warewashing composition is provided in the form of a use composition. It is not entirely clear what exact ion forms are present in the use composition. For example, when the use composition is alkaline, the aluminum ion may be available as an aluminate ion. Accordingly, it should be understood that the terms "aluminum ion," "calcium ion," "magnesium ion," and "zinc ion" refer to ions that contain atoms of aluminum, calcium, magnesium, and zinc, respectively. Any component that provides an aluminum ion in the use composition can be referred to as a source of aluminum ion, any component that provides a calcium ion in a use composition can be referred to as a source of calcium ion, and any component that provides a magnesium ion in the use composition can be referred to as a source of magnesium ion, and any component that provides a zinc ion in the use composition can be referred to as a source of zinc ion. It is not necessary for the source of aluminum ion, the source of calcium ion, the source of magnesium ion, and the source of zinc ion to undergo a reaction to form the aluminum ion, the calcium ion, the magnesium ion, or the zinc ion. Aluminum ion can be considered a source of aluminum ion, calcium ion can be considered a source of calcium ion, magnesium ion can be considered sources of magnesium ion, and zinc ion can be provided as a source of zinc ion. Furthermore, the sources of ion can be provided as elemental metal, organic salts, inorganic salts, organic oxides, inorganic oxides, or mixtures thereof. The source of ion can be provided as an anhydrous component or as a hydrated component.

Exemplary sources of aluminum ion include aluminum and aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, aluminum oxide, aluminum phosphate, sodium aluminosilicate, and mixtures thereof.

Exemplary sources of calcium ion include calcium salts such as calcium borate, calcium perborate, calcium percarbonate, calcium acetate, calcium arsenate, calcium arsenide, calcium azide, calcium benzoate, calcium meta-borate, calcium hexa-boride, calcium bromate, calcium bromide, calcium di-carbide, calcium carbonate, calcium chlorate, calcium chloride, calcium chlorite, calcium chromate, calcium citrate, calcium cyanamide, calcium cyanide, calcium diphosphate, calcium dithionate, calcium fluoride, calcium difluoride hexakisphosphate, calcium formate, calcium d-gluconate, calcium glycerophosphate, calcium hydride, calcium hydrogen phosphate, calcium hydrogen sulfide, calcium hydroxide, calcium hypochlorite, calcium iodate, calcium iodide, calcium iron oxide, calcium lactate, calcium laurate, calcium lead oxide, calcium magnesium carbonate, calcium magnesium silicon oxide, calcium metaphosphate, calcium molybdate, calcium nitrate, calcium nitride, calcium nitrite, calcium oleate, calcium oxalate, calcium oxide, calcium palmitate, calcium pantothenate, calcium perchlorate, calcium permanganate, calcium peroxide, calcium phosphate, calcium phosphide, calcium phosphinate, calcium salicylate, calcium selenate, calcium selenide, calcium silicate, calcium di-silicide, calcium silicon oxide, calcium silicon titanium oxide, calcium stearate, calcium succinate, calcium sulfate, calcium sulfide, calcium sulfite, calcium tartrate, calcium meso-tartrate-3-water telluride, calcium thiosulfate, calcium titanate, calcium titanium oxide, calcium tungstate, calcium vanadium oxide, calcium aluminosilicate, and calcium zirconate.

Exemplary sources of magnesium ion include magnesium salts such as magnesium borate, magnesium perborate, magnesium percarbonate, magnesium acetate, magnesium acetylsalicylate, magnesium di-aluminate, magnesium amide, magnesium antimonide, magnesium arsenate, magnesium arsenide, magnesium benzoate, magnesium bismuthide, magnesium borate, magnesium di-borate, magnesium di-boride, magnesium bromate, magnesium bromide, magnesium carbonate, magnesium carbonate-hydroxide, magnesium chlorate, magnesium chloride, magnesium chromate, magnesium citrate, magnesium diphosphate, magnesium ferrate, magnesium fluoride, magnesium formate, magnesium germanide, magnesium hydride, magnesium hydrogen arsenate, magnesium hydrogen phosphate, magnesium hydroxide, magnesium iodate, magnesium iodide, magnesium lactate, magnesium mandelate, magnesium molybdate, magnesium nitrate, magnesium nitride, magnesium nitrite, magnesium oleate, magnesium oxalate, magnesium oxide, magnesium perchlorate, magnesium permanganate, magnesium peroxide, magnesium peroxoborate, magnesium phosphate, magnesium phosphide, magnesium phosphinate, magnesium salicylate, magnesium silicate, magnesium silicon oxide, magnesium sulfate, magnesium d-tartrate, magnesium telluride, magnesium thiosulfate, magnesium aluminosilicate, and magnesium tungstate.

Exemplary sources of zinc ion include salts such as zinc peroxide, zinc borate, zinc perborate, zinc percarbonate, zinc-containing clays, zinc-containing polymers, zinc acetate, zinc aluminum oxide, zinc di-amide, zinc bromate, zinc bromide, zinc carbonate, zinc chlorate, zinc chloride, zinc chromate, zinc formate, zinc hydroxide, zinc iodate, zinc iodide, zinc iron oxide, zinc nitrate, zinc nitride, zinc oxalate, zinc oxide, zinc peroxide, zinc p-phenolsulfonate, zinc phosphate, zinc phosphide, zinc propionate, zinc silicate, zinc stearate, zinc sulfate, zinc sulfide, zinc sulfite, zinc aluminosilicate, and zinc telluride.

The source of aluminum ion, the source of calcium ion, the source of magnesium ion, and the source of zinc ion can be selected as those components that are characterized by the United States Food and Drug Administration as direct or indirect food additives. Because the warewashing detergent composition can be used to wash articles that contact food, it may be desirable to select the source of aluminum ion, the source of calcium ion, and the source of magnesium ion as components that are characterized by the United States Food and Drug Administration as direct or indirect food additives.

The source of aluminum ion, the source of calcium ion, the source of magnesium ion, and the source of zinc ion can be provided in forms that assist in solubilizing in water (e.g. the use composition). For example, the size of the source of aluminum ion, the source of calcium ion, the source of magnesium ion, and the source of zinc ion can be adjusted to enhance solubility. The source of aluminum ion, the source of calcium ion, the source of magnesium ion, and the source of zinc ion can be provided as particles having a size less than about 500 nm to increase the rate solubility. For example, providing the sources of ion as nanoparticles can help increase the rate of solubility.

It is theorized that the corrosion inhibitor may provide anticorrosion or antifilming properties as a result of interaction of the aluminum ion and at least one of the calcium ion, the magnesium ion, or the zinc ion and precipitation thereof onto the surfaces of articles that are being washed. That is, it is theorized that the aluminum ion and at least one of the calcium ion, the magnesium ion, or the zinc ion can interact in the use composition and precipitate onto a glass surface to protect the glass surface. In addition, it is believed that the precipitate may remain with the article until it is removed, for example, in a subsequent dishwashing operation. As a result of a controlled precipitation of a removable film onto the glass surface, it is believed that the glass surface can be protected from corrosion. In addition, it is believed that a relatively rapid deposition of aluminum precipitate onto the glass surface can cause a filming that can be perceived as corrosion as a result of a cloudy appearance wherein the cloudy appearance may be irreversible or fairly difficult to remove. Accordingly, the selection of the amounts and ratios of aluminum ion, calcium ion, magnesium ion, and zinc ion can be controlled, based on the environment in which the detergent composition is to be used, to proved a desired level of precipitation onto the glass surface to provide a film that protects against etching of the glass and is not so thick that it becomes visible to the naked eye. Furthermore, by providing a relatively thin film or a controlled deposition of precipitate on the glass surface, the thin film can be removed during subsequent cleaning and a new film can be deposited to provide a protective layer. The precipitate film can be considered removable so that it does not permanently build up to form an iridescent film or surface cloudiness. As a result, the precipitate film is available to protect the glass but can be removed and regenerated as a result of subsequent washings.

The film that forms on the glass surface by the corrosion inhibitor precipitate can be substantially invisible to the naked eye. It should be understood that the phrase "substantially invisible to the naked eye" refers to the lack of filming noticable by an individual casually inspecting the glass in normal use situations (e.g., at a dinner table). Visible filming refers to a cloudy appearance that may begin with an iridescent film that displays rainbow hues in light reflected from the glass. By controlling the corrosion inhibitor, the amount of precipitate that forms on the glass can be controlled to provide a film on the glass that is both substantially invisible to the naked eye and that functions as a protective layer. By functioning as a protective layer, the film formed by precipitation can provide resistance to corrosion of the glass surface. That is, other components of the use composition such as alkalinity and builders or sequestrants may attack the protective layer before attacking the glass surface. It is believed that the protective layer can function as a sacrificial layer wherein the alkalinity, builders, or sequestrants attack the sacrifical layer and remove portions of the sacrifical layer.

In have been observed that calcium, magnesium, and zinc interact with aluminum at different rates to cause precipitation. In general, calcium ion tends to interact more quickly with aluminum ion to cause precipitation compared with zinc ion and magnesium ion. Magnesium ion tends to interact more slowly with aluminum ion to cause precipitation than calcium ion or zinc ion. In general, the rate of zinc ion interacting with aluminum ion to cause precipitation is between that of the rate of calcium ion and aluminum ion precipitation and the rate of magnesium ion and aluminum ion precipitation. This observation can be relied upon to select the corrosion inhibitor for use when the water of dilution is hard water or soft water. In general, in situation where the water dilution is hard water, it may desirable to provide more magnesium ion as part of the corrosion inhibitor. In the case where the water of dilution is soft water, it may be more desirable to provide calcium ion in the corrosion inhibitor.

The corrosion inhibitor for the warewashing composition can be selected based upon the presence or absence of phosphorous containing compounds in the warewashing composition, and the expected level of water hardness of the water of dilution. In general, there is desirability for providing warewashing compositions that are free of phosphorous containing compounds (e.g., free of intentionally added phosphorous containing compounds). Because phosphorous containing compounds such as phosphates and phosphonates are typically used as builders or chelating agents, it is often desirable to replace the phosphorous containing builders or chelating agents with non-phosphorous containing components as builders or chelating agents in compositions that are free of phosphorous. Many non-phosphorous containing builders or chelating agents have a tendency to chelate zinc. Accordingly, non-phosphorous containing builders or chelating agents may bind with zinc making the zinc ion unavailable for precipitation with aluminum to form a protective layer.

Washing glass in the presence of hard water can be problematic because the calcium in the water has a tendency to interact with the corrosion inhibitor and precipitate onto the glass surface fairly rapidly resulting in a visible film. The existence of a visible film can be referred to as "filming" and is considered a type of corrosion because it is substantially irreversible. It should be understood that the phrase "substantially irreversible" refers to the inability of the film to disappear as a result of conventional washing. It is believed that a portion of the film may be removed as a result of careful treatment with certain types of chemicals in a laboratory. In a dishwashing machine, such treatment to remove the visible filming would be impractical. The calcium in hard water has a tendency to interact with the aluminum ion and precipitate onto the glass. In the case of aluminate ion, it is believed that calcium reacts with aluminate ion to form calcium aluminate that precipitates relatively quickly.

Four conditions that can effect the selection of the corrosion inhibitor to provide a desired rate of protective layer deposition on a glass surface include: (a) the presence of soft water as water of dilution; (b) the presence of hard water as water of dilution; (c) the presence of phosphorus containing compounds as builders or chelating agents; and (d) and the absence of phosphorous containing compounds as builders or chelating agents and the presence of non-phosphorous containing compounds as builders or chelating agents. In view of these four conditions, the corrosion inhibitor can be selected to provide a protective layer during a warewashing operation. In the case of soft water as water of dilution and a warewashing composition containing phosphorous-containing builders or chelating agents, protective films can be formed by deposition of Ca/Al, Ca/Zn/Al, or Zn/Al. In the case of hard water as water of dilution and a warewashing composition containing phosphorous containing builders or chelating agents, protective films can be formed by deposition of Mg/Al, Mg/Zn/Al, or Zn/Al. In the case of soft water as water of dilution and a warewashing composition that is free of phosphorous, protective films can be formed as a result of deposition of Ca/Al or Ca/Mg/Al. In the case of hard water as water of dilution and a warewashing composition free of phosphorous, protective films can be formed by deposition of Mg/Al or Ca/Mg/Al. In general, a protective layer can be formed in each of these four conditions by adjusting the relative amounts of calcium ion, magnesium ion, and zinc ion that precipitates with aluminum ion to form the protective layer.

In should be understood that the characterization "CaAl" and the other characterizations of the corrosion inhibitor in the previous paragraph refers to a film containing the identified metal components when it is clear from the context that a film is being referred to. In the situation where the detergent composition is being referred to, than the characterization can refer to the presence of a source a calcium ion and a source of aluminum ion where, once the detergent composition form a use composition, can form a protective film containing calcium and aluminum.

Various embodiments of the corrosion inhibitor can be provided. It one embodiment, the corrosion inhibitor can be characterized as substantially free of zinc. In another embodiment, the corrosion inhibitor can contain zinc. In general, the corrosion inhibitor can be characterized as substantially free of zinc if the warewashing detergent composition contains no intentionally added zinc. In addition, the corrosion inhibitor can be characterized as substantially free of zinc if the warewashing detergent composition contains no zinc, or if zinc is present, it is present in the warewashing detergent composition in an amount less than 0.01 wt. % based on the weight of the concentrate. The weight of the zinc is based upon the ion or metal form of the zinc. The warewashing detergent composition can be considered zinc-containing when the concentrate contains greater than 0.01 wt. % zinc based on the weight of the concentrate wherein the weight of the zinc is based on the ion or metal form of the zinc.

Because of the chelating effects several non-phosphorous containing builders or chelating agents have on zinc, it can be desirable to provide the corrosion inhibitor without zinc in the non-phosphorous containing builders or chelating agent systems in order to provide a more effective builder or chelating agent. In other words, because certain non-phosphorous containing builder chelating agent tends to chelate with the zinc, it can be desirable to provide a corrosion inhibitor that is not based upon zinc. Because of the absence of zinc, the non-phosphorous containing builder or chelating agent will not get bound up with the zinc. Furthermore, there can be an advantage to providing a warewashing composition that is free of zinc. There can be an addition cost associated with treatment of waste water containing zinc. Accordingly, the removal of zinc from a warewashing composition can be advantageous. In the case of a substantially zinc free warewashing detergent composition, the corrosion inhibitor can be provided as a calcium/aluminum corrosion inhibitor, a magnesium/aluminum corrosion inhibitor, or a magnesium/calcium/aluminum corrosion inhibitor. The calcium/aluminum corrosion inhibitor can be favored in a zinc free warewashing composition where the water of dilution is expected to soft water. The calcium/aluminum corrosion inhibitor can contain an amount of the source of calcium ion and an amount of the source of aluminum ion to provide desired corrosion inhibiting properties. The calcium/aluminum corrosion inhibitor can be provided having a molar ratio of calcium ion to aluminum ion of less that about 1:4 (e.g., 0.5:1 or 1:5) or a molar ratio of calcium ion to aluminum ion of greater than about 2:1 (e.g., 3:1). In addition, the calcium/aluminum corrosion inhibitor can be provided having a molar ration of calcium ion to aluminum ion of less than about 1:5 or a molar ratio of calcium ion to aluminum ion of greater than about 3:1. The magnesium/aluminum corrosion inhibitor can be favored in a zinc free warewashing composition that is intended to be used with water of dilution that can be considered hard water. The magnesium/aluminum corrosion inhibitor can be selected containing an amount of the source of magnesium ion and an amount of the source of aluminum ion to provide desired corrosion inhibiting properties. In general, the magnesium/aluminum corrosion inhibitor can be selected having a molar ratio of the magnesium ion to the aluminum ion that is greater than about 1:3 (e.g., 2:3) and less than about 3:1 (e.g., 2:1). In addition, the magnesium/aluminum corrosion inhibitor can be selected having a molar ratio of magnesium ion to aluminum ion that is greater than about 2:3 and less than about 2:1. It should be understood that the characterization of an exemplary amount after a range characterization is intended to show what is meant by the range characterization and is not intended to limit the range to a specific point. For example, a range expressed as a ratio of less than about 3:1 includes within the range the ratio of 2:1.

The calcium/magnesium/aluminum corrosion inhibitor can be selected when the warewashing composition is free of zinc, and where the water of dilution can be either hard water or soft water. In general, the amounts of calcium ion, magnesium ion, and aluminum ion for the corrosion inhibitor for use in either hard water or soft water can be determined based upon the following equation:

$$[(2.8*Mg+3.9*Ca+3.7*Al-4.4*Mg*Ca-6.2*Mg*Al-4.5*Ca*Al-34.2*Mg*Ca*Al-5.7*Mg*Ca*(Mg—Ca)+11.6*Mg*Al*(Mg—Al)-4.0*Ca*Al*(Ca—Al)-3/(95.3*111*82)]\geqq 0 \quad \text{Equation No. 1}$$

In the case of a zinc containing warewashing detergent composition, the corrosion inhibitor can be provided as a calcium/zinc/aluminum corrosion inhibitor, a magnesium/zinc/aluminum corrosion inhibitor, or a calcium/magnesium/zinc/aluminum corrosion inhibitor. The calcium/zinc/aluminum corrosion inhibitor can be favored in environments where the water of dilution is expected to be soft water. In general, the selection of the amounts of the calcium ion, zinc ion, and aluminum ion for this corrosion inhibitor can be controlled by the following equation:

$$[(0.82*Al+0.9*Ca+Zn+6*Al*Ca+10.3*Al*Zn+0.56*Ca*Zn+17.7*Al*Ca*Zn+4.1*Al*Ca*(Al—Ca)\ 5.1*Al*Zn*(Al—Zn)+1.1*Ca*Zn*(Ca—Zn)-3)/(111*136.4*82)]>0 \quad \text{Equation No. 2}$$

The magnesium/zinc/aluminum corrosion inhibitor can be favored in environments where the water of dilution is hard water. In general, the selection of the amounts of magnesium ion, zinc ion, and aluminum ion for this corrosion inhibitor can be determined based upon the following equation:

$$[(1.2Mg+3.2*Zn+1.2*Al-2.4*Mg*Zn+5.1*Mg*Al+5.1*Zn*Al+3.3*Mg*Zn*Al-4.8*Mg*Zn(Mg—Zn)-2.7*Mg*Al(Mg—Al)-8.7*Na*Al*(Zn—Al)-3)/(95.3*36.4*82)]>0 \quad \text{Equation No. 3}$$

The calcium/magnesium/zinc/aluminum corrosion inhibitor can be used in environments where the water of dilution is either hard water or soft water. In general, the amounts of calcium ion, magnesium ion, zinc ion, and aluminum ion for this corrosion inhibitor can be selected based upon the following formula:

$$1.8\text{-}3.2\ (Mg+Zn):9\text{-}32\ \text{moles Ca}:1.0\text{-}7.3\ \text{moles Al} \quad \text{Equation No. 4}$$

It should be understood that Equation Nos. 1-4 are the result of computer analysis of empirical studies using the computer program Design Expert. Furthermore, the amounts of the identified metal component are provided as molar amount.

The corrosion inhibitor can be provided in the use composition in an amount effective to reduce corrosion of glass. It is expected that the use composition will include at least about 6 ppm of the corrosion inhibitor to provide desired corrosion inhibition properties. The amount of the corrosion inhibitor is calculated based upon the combined amount of the source of aluminum ion, source of calcium ion, source of magnesium ion, and the source of zinc ion. It is expected that larger amounts of corrosion inhibitor can be used in the use composition without deleterious effects. It is expected that at a certain point, the additive effect of increased corrosion resistance with increasing corrosion inhibitor concentration will be lost, and additional corrosion inhibitor will simply increase the cost of using the cleaning composition. In the case of a use composition containing in excess of 200 ppm free calcium ion, it is expected that providing a higher concentration of aluminum ion may increase the availability of the calcium ion to precipitate with the aluminum ion. Accordingly, the upper limit of the concentration of the corrosion inhibitor can be selected to avoid visible filming. The use composition can include about 6 ppm to about 300 ppm of the corrosion inhibitor, and about 20 ppm to about 200 ppm of the corrosion inhibitor. In the case of the concentrate that is intended to be diluted to a use composition, the corrosion inhibitor can be provided at a concentration of at least about 0.01 wt. %, can be provided at a concentration of at least about 0.05 wt. %, and can be provided at a concentration of at least about 0.1 wt. %. For example, the concentrate can contain the corrosion inhibitor in an amount of about 0.05 wt. % to about 25 wt. %, about 0.1 wt. % to about 15 wt. %, about 0.3 wt. % to about 10 wt. %, and about 0.5 wt. % to about 5 wt. %.

Alkaline Sources

The warewashing composition according to the invention may include an effective amount of one or more alkaline sources to enhance cleaning of a substrate and improve soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be more safe than the caustic based use compositions.

The warewashing composition can include an alkali metal carbonate and/or an alkali metal hydroxide. Exemplary metal carbonates that can be used include, for example, sodium or potassium carbonate, bicarbonate, sesquicarbonate, mixtures thereof. Exemplary alkali metal hydroxides that can be used include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt. % and a 73 wt. % solution.

The warewashing composition can include a sufficient amount of the alkaline source to provide the use composition with a pH of at least about 8. In general, it is expected that the concentrate will include the alkaline source in an amount of at least about 5 wt. %, at least about 10 wt. %, or at least about 15 wt. %. In order to provide sufficient room for other components in the concentrate, the alkaline source can be provided in the concentrate in an amount of less than about 60 wt. %. In addition, the alkaline source can be provided at a level of less than about 40 wt. %, less than about 30 wt. %, or less than about 20 wt. %. It is expected that the warewashing composition may provide a use composition that is useful at pH levels below about 8. In such compositions, an alkaline source may be omitted, and additional pH adjusting agents may be used to provide the use composition with the desired pH. Accordingly, it should be understood that the source of alkalinity can be characterized as an optional component.

Cleaning Agent

The warewashing composition can include at least one cleaning agent comprising a surfactant or surfactant system. A variety of surfactants can be used in a warewashing composition, such as anionic, nonionic, cationic, and zwitterionic surfactants. It should be understood that surfactants are an optional component of the warewashing composition and can be excluded from the concentrate.

Exemplary surfactants that can be used are commercially available from a number of sources. For a discussion of surfactants, see Kirk-Othmer, Encyclopedia of Chemical Technology, Third Edition, volume 8, pages 900-912. When the warewashing composition includes a cleaning agent, the cleaning agent can be provided in an amount effective to provide a desired level of cleaning.

Anionic surfactants useful in the warewashing composition includes, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Nonionic surfactants useful in the warewashing composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants that can be used in the warewashing composition include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties.

Zwitterionic surfactants that can be used in the warewashing composition include betaines, imidazolines, and propionates. Because the warewashing composition is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the warewashing composition and the level of foaming can be controlled by the addition of a defoaming agent.

The warewashing composition, when provided as a concentrate, can include the cleaning agent in a range of about 0.05 wt. % to about 20 wt. %, about 0.5 wt. % to about 15 wt. %, about 1 wt. % to about 15 wt. %, about 1.5 wt. % to about 10 wt. %, and about 2 wt. % to about 5 wt. %. Additional exemplary ranges of surfactant in a concentrate include about 0.5 wt. % to about 5 wt. %, and about 1 wt. % to about 3 wt. %.

Other Additives

The warewashing composition can include other additives, including conventional additives such as builders or chelating/sequestering agents, bleaching agents, fillers, hardening agents or solubility modifiers, defoamers, anti-redeposition agents, threshold agents, stabilizers, dispersants, enzymes, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The warewashing composition can include chelating/sequestering agents (e.g., builders) such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrate can include about 1 wt. % to about 60 wt. %, about 3 wt. % to about 50 wt. %, and about 6 wt. % to about 45 wt. % of the builders. Additional ranges of the builders include about 3 wt. % to about 20 wt. %, 6 wt. % to about 15 wt. %, 25 wt. % to about 50 wt. %, and 35 wt. % to about 45 wt. % depending upon whether the warewashing composition is provided as a liquid or as a solid.

The builder or chelating agent can be provided as a non-phosphorous containing builder or chelating agents. Exemplary non-phosphorous builder or chelating agents include: aminocarboxylic acids, such as, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$ (HEDP); amino tri(methylenephosphonic acid) $N[CH_2PO(OH)_2]_3$; aminotri(methylenephosphonate), sodium salt

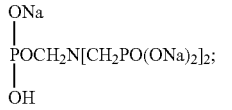

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$. Exemplary phosphonates are HEDP, ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

Water conditioning polymers can be used as a form of builder. Exemplary water conditioning polymers include polycarboxylates. Exemplary polycarboxylates that can be used as builders and/or water conditioning polymers include those having pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. The concentrate can include the water conditioning polymer in an amount of between about 0.1 wt. % and about 5 wt. %, and between about 0.2 wt. % and about 2 wt. %.

Bleaching agents for use in a cleaning compositions for lightening or whitening a substrate, include bleaching compounds capable of liberating an active halogen species, such as $Cl_2$, $Br_2$, $—OCl^-$ and/or $—OBr^-$, under conditions typically encountered during the cleansing process. Suitable bleaching agents for use in the present cleaning compositions include, for example, chlorine-containing compounds such as a chlorine, a hypochlorite, chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

The composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included an amount of about 1 wt. % to about 20 wt. % and between about 3 wt. % to about 15 wt. %.

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluranic N-3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Stabilizing agents that can be used include primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include about 0 to about 20 wt. %, about 0.5 wt. % to about 15 wt. %, and about 2 wt. % to about 10 wt. %.

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be about 0 to about 20 wt. %, about 0.5 wt. % to about 15 wt. %, and about 2 wt. % to about 9 wt. %.

Enzymes that can be included in the composition include those enzymes that aid in the removal of starch and/or protein stains. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme. When the concentrate includes an enzyme, it can be included in an amount that provides the desired enzymatic activity when the warewashing composition is provided as a use composition. Exemplary ranges of the enzyme in the concentrate include about 0 to about 15 wt. %, about 0.5 wt. % to about 10 wt. %, and about 1 wt. % to about 5 wt. %.

Silicates can be included in the warewashing composition to provide for metal protection. Silicates are additionally known to provide alkalinity and additionally function as anti-redeposition agents. Exemplary silicates include sodium silicate and potassium silicate. The warewashing composition can be provided without silicates, but when silicates are included, they can be included in amounts that provide for desired metal protection. The concentrate can include silicates in amounts of at least about 1 wt. %, at least about 5 wt. %, at least about 10 wt. %, and at least about 15 wt. %. In addition, in order to provide sufficient room for other components in the concentrate, the silicate component can be provided at a level of less than about 35 wt. %, less than about 25 wt. %, less than about 20 wt. %, and less than about 15 wt. %.

The concentrate can include water. In general, it is expected that water may be present as a processing aid and may be removed or become water of hydration. It is expected that water may be present in both the liquid concentrate and in the solid concentrate. In the case of the liquid concentrate, it is expected that water will be present in a range of between about 5 wt. % and about 60 wt. %, between about 10 wt. % and about 35 wt. %, and between about 15 wt. % and about 25 wt. %. In the case of a solid concentrate, it is expected that the water will be present in ranges of between about 0 wt. % and about 10 wt. %, about 0.1 wt. % and about 10 wt. %, about 1 wt. % and about 5 wt. %, and about 2 wt. % and about 3 wt. %. It should be additionally appreciated that the water may be provided as deionized water or as softened water.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine orjasmal, vanillin, and the like.

The components used to form the concentrate can include an aqueous medium such as water as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Forming the Concentrate

The components can be mixed and extruded or cast to form a solid such as pellets or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water soluble polymers which may be used in the invention are described in Davidson and Sittig, *Water Soluble* Resins, Van Nostrand Reinhold Company, New York (1968), herein incorporated by reference. The water soluble polymer should have proper characteristics such as strength and pliability in order to permit machine handling. Preferred water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product can be removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

While the invention is described in the context of a warewashing composition for washing articles in an automatic dishwashing machine, it should be understood that the warewashing composition can be used for washing non-ware items. That is, the warewashing composition can be referred to as a cleaning composition and can be used to clean various items and, in particular, items that may suffer from corrosion and/or etching. It should be understood that certain components that may be included in a warewashing composition because it is intended to be used in an automatic dishwashing machine can be excluded from a cleaning composition that is not intended to be used in an automatic dishwashing machine, and vice versa. For example, surfactants that have a tendency to create quite a bit of foaming may be used in a cleaning composition that is not intended to be used in an automatic dishwashing machine. Applications for a cleaning composition that includes a corrosion inhibitor that reduces corrosion of glass includes cleaning of hard surfaces. Exemplary hard surfaces include those that contain glass and/or ceramic. Exemplary surfaces include windows and mirrors. It should be understood that such a cleaning composition may find application in the vehicle washing industry because of the presence of glass on motor vehicles.

The warewashing composition can be provided in several forms including solids and liquids. When provided in the form of a solid, the warewashing composition can be provided in the form of powder, granules, pellets, tablets, blocks, cast solids, and extruded solids. By way of example, pellets can have sizes of between about 1 mm and about 10 mm diameter, tablets can have sizes of between about 1 mm and about 10 mm diameter, tablets can have sizes of between about 1 cm and about 10 cm diameter, and blocks can have sizes of at least about 10 cm diameter. When provided in the form of a liquid, the warewashing composition can be provided as a gel or a paste.

Exemplary ranges for components of the warewashing composition when provided as a gel or a paste are shown in Table 1. Exemplary ranges for components of the warewashing composition when provided as a solid are shown in Table 2.

TABLE 1

Gel or Paste Warewashing Composition

| Component | First Exemplary Range (wt. %) | Second Exemplary Range (wt. %) | Third Exemplary Range (wt. %) |
|---|---|---|---|
| Water | 5-60 | 10-35 | 15-25 |
| Alkaline Source | 5-40 | 10-30 | 15-20 |
| Silicate | 0-35 | 5-25 | 10-20 |
| Builder | 1-30 | 3-20 | 6-15 |
| Stabilizer | 0-20 | 0.5-15 | 2-10 |
| Dispersant | 0-20 | 0.5-15 | 2-9 |
| Enzyme | 0-15 | 0.5-10 | 1-5 |
| Corrosion Inhibitor | 0.05-15 | 0.5-10 | 1-5 |
| Surfactant | 0.05-15 | 0.5-10 | 1-5 |
| Fragrance | 0-10 | 0.01-5 | 0.1-2 |
| Dye | 0-1 | 0.001-0.5 | 0.01-0.25 |

TABLE 2

Solid Warewashing Composition

| Component | First Exemplary Range (wt. %) | Second Exemplary Range (wt. %) | Third Exemplary Range (wt. %) |
|---|---|---|---|
| Water | 0-50 | 1-30 | 5-20 |
| Alkaline Source | 5-40 | 10-30 | 15-20 |
| Builder | 1-60 | 25-50 | 35-45 |
| Bleach | 0-55 | 5-45 | 10-35 |
| Silicate | 0-35 | 5-25 | 10-15 |
| Dispersant | 0-10 | 0.001-5 | 0.01-1 |
| Enzyme | 0-15 | 1-10 | 2-5 |
| Corrosion Inhibitor | 0.05-15 | 0.05-10 | 1-5 |
| Surfactant | 0.05-15 | 0.5-10 | 1-5 |
| Fragrance | 0-10 | 0.01-5 | 0.1-2 |
| Dye | 0-1 | 0.001-0.5 | 0.01-0.25 |

The various forms of the warewashing composition concentrate can be provided in a water soluble packaging film. That is, solids and liquids can be packaged in the water soluble films. Exemplary solids that can be packaged in a water soluble film include powders, pellets, tablets, and blocks. Exemplary liquids that can be packaged in the water soluble film include gels and pastes.

The above specification provides a basis for understanding the broad meets and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

Composition A and composition B are reported in Table 3.

TABLE 3

| Component | Composition A (wt %) | Composition B (wt %) |
|---|---|---|
| Water | 94.15 | 82.83 |
| HEDP (60%)* | 0 | 6.70 |
| NaOH (50%) | 4.10 | 7.60 |
| $ZnCl_2$ (97%) | 0.50 | 0 |
| $CaCl_2$ (78%) | 0 | 0.62 |
| $NaA10_2$ (22.5%) | 1.25 | 1.25 |

*HEDP is a phosphonate available as Dequest 2010 from Solutia.

EXAMPLES

The following examples were conducted to compare the etching of glassware from Libbey glass based on several warewashing compositions. The glassware obtained was unused and fresh out of the box. One glass was used per test. The containers used to hold the sample were quart plastic containers without paper liners in the lid.

The following procedure was followed.

1. Place gloves on before washing the glasses to prevent skin oils from contacting the glassware.
2. The glassware is scrubbed thoroughly with neutral pH liquid dish detergent (a pot and pan detergent available under the name "Express" from Ecolab Inc.) to remove dirt and oil and allowed to air dry.
3. Rinse all plastic containers with distilled water to remove any dust and allow to air dry.
4. Detergent solutions are prepared.
5. Place one glass in each plastic container and pour a solution into the plastic container ensuring that the glass is completely covered. Put the lid on the container and label with the solution name.
6. 20 mL of each solution is poured into 1 oz. plastic bottles and labeled.
7. Place the plastic containers in an agitated water bath. Control the temperature of the water bath to 160° F.
8. A water dispensing mechanism is set up to replenish the water bath throughout the duration of the test.
9. Collect 20 mL samples of the solution every 48 hours and place in the 1 oz. plastic bottles.
10. Upon completion of the test, samples were analyzed for calcium and silicon content.
11. Weigh glasses before and after the 48 hour test.

To measure glass corrosion and demonstrate the protective effect of the corrosion inhibitor, the rates at which components were removed from the glassware exposed to the detergent solutions are measured. Over a period of days, the change in concentration of elemental silicon and elemental calcium in the detergent solution samples was analytically measured. Common soda-lime glass includes oxides of silicon, sodium, calcium, magnesium, and aluminum. Since it is well known that detergent builders can form complexes with calcium, the presence of calcium in the test solutions was measured to determine whether the detergent builders were accelerating the removal of calcium from the glass surface, thereby contributing to the corrosion process. The glass specimens were submerged in the detergents solutions at elevated temperatures. Polyethylene bottles were used to contain the solutions, so the only source of the elements of interest was the glass specimens.

The results of this example are reported in Table 4.

TABLE 4

| Run | Inhibitor metal | NaOH (g/l) | $Na_2CO_3$ (g/l) | Inhibitor | Inhibitor conc (mg/l) | before glass wt (g) | after glass wt (g) | Difference wt. Loss (mg) | Wt change (%) | Silicon removed from glass (g) |
|---|---|---|---|---|---|---|---|---|---|---|
| 1 | zinc | 25 | 13 | Composition A (0.07% actives) | 40 | 163.8780 | 163.7034 | 175 | 0.107 | 0.054 |
| 2 | zinc | 25 | 13 | Composition A (0.035% actives) | 20 | 166.9305 | 166.7908 | 140 | 0.084 | 0.068 |
| 3 | calcium | 25 | 13 | Composition B (0.075% actives) | 40 | 166.5527 | 166.4424 | 110 | 0.066 | 0.039 |
| 4 | calcium | 25 | 13 | Composition B (0.038% actives) | 20 | 167.5155 | 167.4042 | 111 | 0.066 | 0.041 |
| 5 | control | 25 | 13 | No inhibitor | 0 | 169.2410 | 167.4042 | 389 | 0.230 | 0.175 |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A warewashing detergent composition comprising:

(a) a cleaning agent comprising a detersive amount of a surfactant wherein the detergent composition comprises about 0.05 wt. % to 5 wt. % of the surfactant;

(b) an alkaline source in an amount effective to provide a use composition having a pH of at least about 8 when measured at a solids concentration of about 0.5 wt. %; and (c) a corrosion inhibitor in an amount sufficient for reducing corrosion of glass when the warewashing detergent composition is combined with water of dilution at a dilution ratio of dilution water to detergent composition of at least about 20:1, the corrosion inhibitor comprising:

(i) a source of water soluble aluminum ion selected from the group consisting of sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum bromate, aluminum borate, aluminum potassium sulfate, aluminum zinc sulfate, aluminum phosphate, or mixtures thereof; and (ii) at least one of a source of water soluble calcium ion selected from the group consisting of calcium borate, calcium perborate, calcium percarbonate, calcium acetate, calcium arsenate, calcium arsenide, calcium azide, calcium benzoate, calcium meta-borate, calcium hexa-boride, calcium bromate, calcium bromide, calcium di-carbide, calcium carbonate, calcium chlorate, calcium chloride, calcium chlorite, calcium chromate, calcium citrate, calcium cyanamide, calcium cyanide, calcium diphosphate, calcium dithionate, calcium fluoride, calcium difluoride hexakisphosphate, calcium formate, calcium d-gluconate, calcium glycerophosphate, calcium hydride, calcium hydrogen phosphate, calcium hydrogen sulfide, calcium hydroxide, calcium hypochlorite, calcium iodate, calcium lactate, calcium nitrate, calcium nitride, calcium nitrite, calcium pantothenate, calcium perchlorate, calcium permanganate, calcium peroxide, calcium phosphate, calcium phosphide, calcium phosphinate, calcium salicylate, calcium selenate, calcium selenide, calcium silicate, calcium disilicide, calcium silicon oxide, calcium silicon titanium oxide, calcium stearate, calcium succinate, calcium sulfate, calcium sulfide, calcium sulfite, calcium tartrate, calcium meso-tartrate-3-water telluride, calcium thiosulfate, calcium tungstate, or mixtures thereof; or a source of water soluble magnesium ion selected from the group consisting of magnesium acetate, magnesium bromate, magnesium bromide, magnesium chlorate, magnesium chloride, magnesium chromate, magnesium citrate, magnesium formate, magnesium iodate, magnesium iodide, magnesium lactate, magnesium molybdate, magnesium nitrate, magnesium oleate, magnesium perchlorate, magnesium phosphinate, magnesium salicylate, magnesium sulfate, magnesium thiosulfate, or mixtures thereof; and either a. when the corrosion inhibitor comprises a calcium/aluminum corrosion inhibitor the molar ratio of calcium ion to aluminum ion is less than about 1:4 or a molar ratio of calcium ion to aluminum ion is greater than about 2:1; or b. when the corrosion inhibitor comprises a magnesium/aluminum corrosion inhibitor the molar ratio of magnesium ion to aluminum ion comprises 3 or more magnesium ions per aluminum ion or 3 or more aluminum ions per magnesium ion, and wherein d) the detergent composition is substantially free of zinc and is provided as a solid block.

2. A warewashing detergent composition according to claim 1, wherein the cleaning agent comprises an anionic surfactant, a nonionic surfactant, a cationic surfactant, or a zwitterionic surfactant.

3. A warewashing detergent composition according to claim 1, wherein the detergent composition comprises between about 0.05 wt. % and about 15 wt. % of the corrosion inhibitor.

4. A warewashing detergent composition according to claim 1, wherein the composition is free of phosphorous containing compounds.

5. A warewashing detergent composition according to claim 1, wherein the composition comprises about 1 wt. % to about 60 wt. % of a builder, wherein the builder comprises a non-phosphorous containing builder.

6. A warewashing detergent composition according to claim 1, wherein the alkaline source comprises at least one of an alkali metal carbonate, an alkali metal hydroxide, and a mixture thereof.

7. A warewashing detergent composition according to claim 1, wherein the alkaline source comprises at least one of sodium carbonate, potassium carbonate, sodium bicarbonate, potassium bicarbonate, sodium sesquicarbonate, potassium sesquicarbonate, or mixtures thereof.

8. A warewashing detergent composition according to claim 1, wherein the alkaline source comprises at least one of sodium hydroxide, potassium hydroxide, or mixtures thereof.

9. A warewashing detergent composition according to claim 1, wherein the corrosion inhibitor comprises a calcium/aluminum corrosion inhibitor.

10. A warewashing detergent composition according to claim 1, wherein the corrosion inhibitor comprises a magnesium/aluminum corrosion inhibitor.

11. A warewashing detergent composition according to claim 1, wherein the corrosion inhibitor comprises a calcium/magnesium/aluminum corrosion inhibitor.

* * * * *